US008939114B2

(12) United States Patent
Keller

(10) Patent No.: US 8,939,114 B2
(45) Date of Patent: Jan. 27, 2015

(54) PISTON FOR AN INTERNAL COMBUSTION ENGINE

(75) Inventor: Klaus Keller, Lorch (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 13/540,777

(22) Filed: Jul. 3, 2012

(65) Prior Publication Data

US 2013/0008395 A1 Jan. 10, 2013

(30) Foreign Application Priority Data

Jul. 4, 2011 (DE) ..... 10 2011 106 381

(51) Int. Cl.
*F01P 1/04* (2006.01)
*F02F 3/22* (2006.01)

(52) U.S. Cl.
CPC ..... *F02F 3/22* (2013.01)
USPC ..... 123/41.39; 123/193.6

(58) Field of Classification Search
USPC ..... 123/41.34, 41.35, 41.39, 193.1, 193.6, 123/197.2; 92/158, 159, 186
See application file for complete search history.

(56) References Cited

U.S. PATENT DOCUMENTS

| | | | | | |
|---|---|---|---|---|---|
| 2,911,963 | A * | 11/1959 | Goldsmith | 123/41.39 |
| 3,221,718 | A | 12/1965 | Isley | |
| 3,616,729 | A * | 11/1971 | Fischer | 92/56 |
| 4,377,967 | A * | 3/1983 | Pelizzoni | 92/186 |
| 4,506,632 | A * | 3/1985 | Kanda et al. | 123/41.35 |
| 5,081,968 | A * | 1/1992 | Bruni | 123/193.6 |
| 5,317,958 | A * | 6/1994 | Martins Leites et al. | 92/186 |
| 5,357,920 | A * | 10/1994 | Kemnitz et al. | 123/193.6 |
| 5,794,582 | A * | 8/1998 | Horiuchi | 123/197.2 |
| 6,209,510 | B1 * | 4/2001 | Brogdon et al. | 123/197.4 |
| 6,904,876 | B1 * | 6/2005 | Hofbauer et al. | 123/46 R |
| 7,341,037 | B2 * | 3/2008 | Parker et al. | 123/193.6 |
| 7,637,241 | B2 * | 12/2009 | Styron | 123/193.6 |
| 7,721,431 | B2 * | 5/2010 | Parker et al. | 29/888.042 |
| 7,762,227 | B2 * | 7/2010 | Sadowski et al. | 123/193.6 |
| 8,087,395 | B2 | 1/2012 | Scharp et al. | |
| 8,347,842 | B2 * | 1/2013 | Sadowski et al. | 123/193.6 |
| 2008/0110335 | A1 * | 5/2008 | Parker et al. | 92/208 |

(Continued)

FOREIGN PATENT DOCUMENTS

| | | |
|---|---|---|
| DE | 2348726 | 4/1975 |
| DE | 34 23 889 | 2/1985 |
| DE | 199 27 931 | 1/2001 |
| DE | 10 2004 029 926 | 1/2006 |

(Continued)

OTHER PUBLICATIONS

German Search Report dated May 22, 2012 in German Patent Application No. 10 2011 106 381.5 with English translation of relevant parts.

*Primary Examiner* — Noah Kamen
*Assistant Examiner* — Grant Moubry
(74) *Attorney, Agent, or Firm* — Collard & Roe, P.C.

(57) ABSTRACT

The present invention relates to a piston (10) for an internal combustion engine, having a piston head (11) having a piston crown (17), an outer circumferential cooling channel (21), an inner cooling space (22) disposed in the region of the underside (17*a*) of the piston crown (17), which is closed off with a separate closure element (23) that has at least one outflow opening (25) for cooling oil. According to the invention, it is provided that the closure element (23) and the inner cooling space (22) extend all the way to below the outer circumferential cooling channel (21).

10 Claims, 1 Drawing Sheet

(56) References Cited

U.S. PATENT DOCUMENTS

Figure 1:
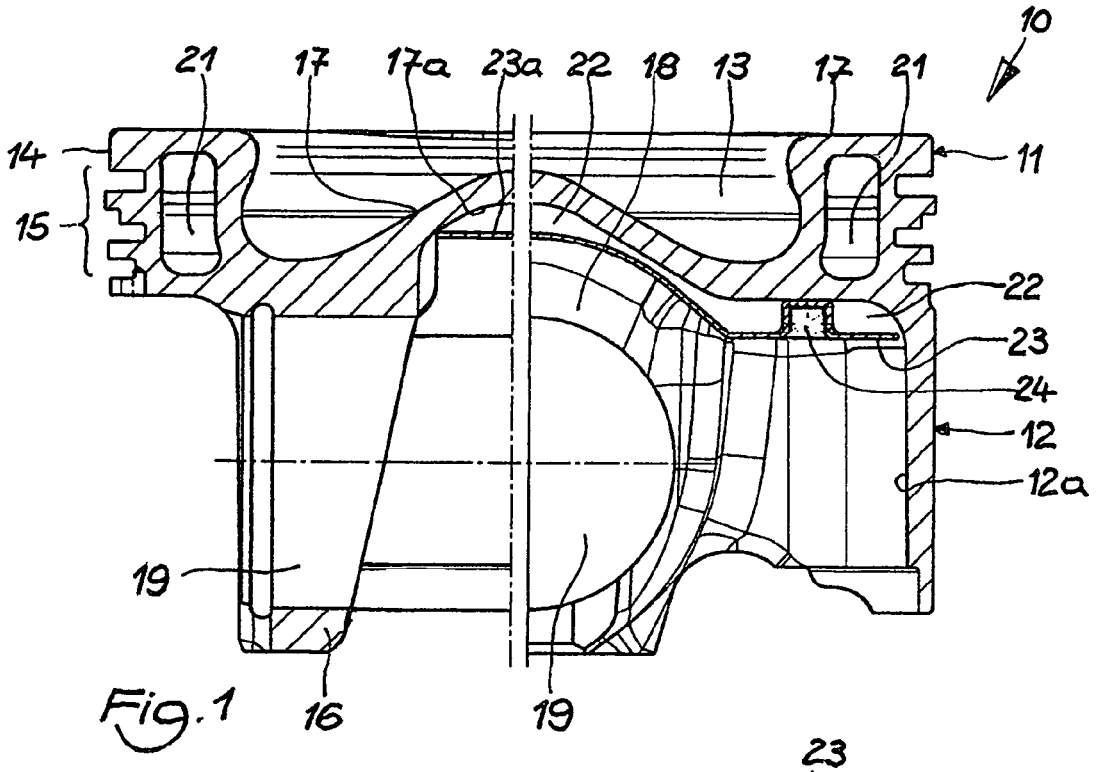

| | | | | |
|---|---|---|---|---|
| 2008/0134879 | A1* | 6/2008 | Hofbauer | 92/186 |
| 2010/0107868 | A1 | 5/2010 | Scharp et al. | |
| 2012/0222632 | A1* | 9/2012 | Scharp | 123/41.37 |

FOREIGN PATENT DOCUMENTS

| | | |
|---|---|---|
| DE | 10 2008 055 908 | 5/2010 |
| DE | 10 2008 055 911 | 5/2010 |
| WO | WO 2007/063899 | 6/2007 |

* cited by examiner

PISTON FOR AN INTERNAL COMBUSTION ENGINE

CROSS REFERENCE TO RELATED APPLICATIONS

Applicant claims priority under 35 U.S.C. §119 of German Application Ser. No. 10 2011 106 381.5 filed on Jul. 4, 2011, the disclosure of which is incorporated by reference.

The present invention relates to a piston for an internal combustion engine, having a piston head having a piston crown, an outer circumferential cooling channel, an inner cooling space disposed in the region of the underside of the piston crown, which is closed off with a separate closure element that has at least one outflow opening and at least one inflow opening for cooling oil.

A piston of this type is disclosed in DE 10 2008 055 908 A1. The known closure element serves for closing off the inner cooling space, in such a manner that cooling oil can flow away, in controlled manner, in the direction of the piston pin, in order to lubricate the piston pin. It is problematic, in this connection, that the known closure element is not always reliably held in its seat during engine operation, because of the forces that act on it during the piston stroke. Furthermore, the known closure element is not suitable for pistons having a completely closed outer cooling channel, such as sodium-cooled pistons, for example.

The task of the present invention consists in further developing a piston of this type in such a manner that the closure element is reliably secured in position, counter to the forces that act on it during the piston stroke, and that its range of use is increased.

The solution consists in that the closure element and the inner cooling space extend all the way to below the outer circumferential cooling channel.

The embodiment according to the invention makes it possible to attach the closure element at any desired holding points in the piston interior, in such a manner that it is reliably secured in position during engine operation. The clearly enlarged inner cooling space, as compared with the state of the art, brings about clearly more effective cooling, particularly in the region below the piston crown, which is subject to great stress. The closure element, which is enlarged as compared with the state of the art, can furthermore be provided, in simple manner, with suitable inflow and outflow openings for cooling oil, in order to guarantee an effective supply with fresh cooling oil and to improve the cooling effect. Because of the expanse of the inner cooling space all the way to below the outer circumferential cooling channel, the wall region between the outer cooling channel and the inner cooling space is cooled particularly effectively, so that heat is conducted away particularly effectively from the piston crown, by way of this wall region, in the direction of the piston skirt. In this manner, the entire piston crown underside is optimally cooled. For this reason, the closure element according to the invention can be used in a greater number of piston types than was possible up to now in the state of the art, for example in sodium-cooled pistons having a completely closed circumferential cooling channel. If the cooling oil circulating in the outer cooling channel exits through outflow openings provided in the cooling channel, in known manner, it is collected by the closure plate provided according to the invention, and thereby contributes to cooling of the piston below the piston crown, in the inner cooling space. Therefore it is possible to do without overflow bores that connected the outer cooling channel with the inner cooling space. This is advantageous because such overflow bores produce additional stresses in the piston material, which are thereby avoided.

Advantageous further developments are evident from the dependent claims.

Preferably, the closure element extends all the way to the inner skirt walls of a piston skirt disposed below the piston head, in order to partition off the largest inner cooling space possible in this region.

The at least one outflow opening for cooling oil can have any desired configuration, for example that of a gap provided between the interior of the piston and an edge of the closure element, or that of one or more bores provided in the closure element.

Particularly preferably, the closure element has at least one inflow opening and at least one outflow opening for cooling oil, in order to supply the inner cooling space with sufficiently fresh cooling and to improve the cooling under the piston crown. For this purpose, a conducting pipe for cooling oil can be additionally provided in the at least one inflow opening, for example.

The outer circumferential cooling channel can be configured to be closed, because the closure element provided according to the invention can be provided with one or more inflow openings for cooling oil. However, the outer circumferential cooling channel can also have at least one outflow opening for cooling oil, in known manner, in such a manner that the oil flowing out is collected by the closure element and, in addition, cools the piston crown underside. The closure element provided according to the invention can therefore be used in numerous different piston types.

Particularly preferably, the closure element is connected with the piston by means of welding, so that it is secured in position particularly reliably during engine operation.

It is practical if the closure element has at least two contact locations that serve as weld points. In another preferred embodiment of the present invention, the contact locations can be configured as spacers between the closure element and the underside of the piston crown. In this way, an inner cooling space having a predefined volume can be partitioned off in particularly simple manner.

In order to further improve the cooling effect, the closure element can have additional cooling ribs.

It is practical if the closure element provided according to the invention is produced from a steel spring sheet.

Figure 2:
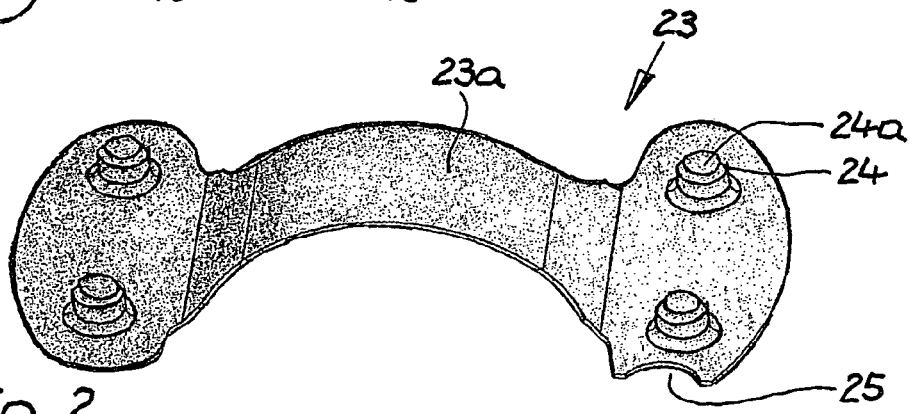
Figure 3:
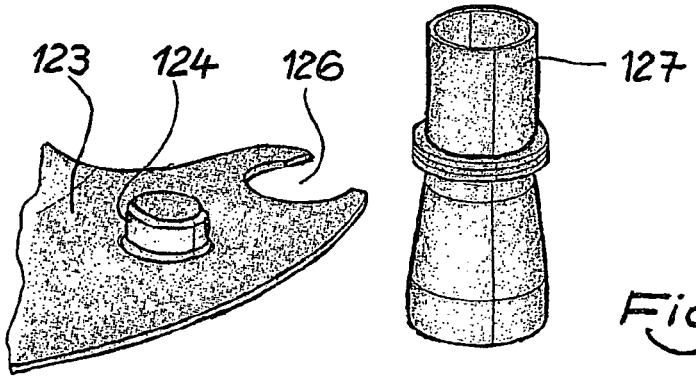

Exemplary embodiments of the invention will be explained in greater detail in the following, using the attached drawings. These show, in a schematic representation, not true to scale:

FIG. 1 a first exemplary embodiment of a piston according to the invention, in section, whereby the representations on the two sides of the center axis are rotated by 90° relative to one another;

FIG. 2 an enlarged representation of a first exemplary embodiment of a closure element according to the invention;

FIG. 3 an enlarged partial representation of a second exemplary embodiment of a closure element according to the invention, having a conducting pipe.

FIG. 1 shows an exemplary embodiment of a piston 10 according to the invention, which is represented, in the exemplary embodiment, as a box piston having a completely closed outer cooling channel. The piston 10 according to the invention has a piston head 11 and a piston skirt 12. The piston head 11 has a piston crown 17 with a combustion bowl 13, a circumferential top land 14, and a circumferential ring belt 15 with ring grooves for accommodating piston rings (not shown). The piston skirt 12 has inner walls 12*a* as well as pin bosses 16 that are connected with the underside 17*a* of the piston crown 17 by way of pin boss connections 18. The pin bosses 16 are provided with pin bores 19 for accommodating a piston pin (not shown). The piston head 11 is provided with a circumferential outer channel 21 in the region of its ring belt 15.

The piston 10 has an inner cooling space 22 that is closed off with a closure element 23. The closure element 23 extends over the entire width of the interior of the piston 10, all the way to the inner walls 12*a* of the piston skirt 12. In the exemplary embodiment, the closure element 23 is produced from a spring sheet, has a thickness of approximately 0.8 mm, and is connected with the piston 10 by means of welding.

As is particularly evident from FIG. 2, the closure element 23, in the exemplary embodiment, has four contact locations 24 that serve as weld points. The contact locations 24 are configured in pot shape in the exemplary embodiment, and are introduced into the closure element 23 by means of embossing. The face surfaces 24*a* of the contact locations 24 form the weld points. The configuration of the contact locations 24 as described brings about the result that these serve as spacers relative to the underside 17*a* of the piston crown 17 in the assembled state. For this reason, an inner cooling space 22 having a defined volume can be partitioned off solely by means of the dimensioning of the axial height of the contact locations 24, by means of the closure element 23. The mantle surfaces of the contact locations 24 can furthermore serve as guide surfaces for guiding the cooling oil accommodated in the inner cooling space 22 in a desired direction. Furthermore, heat can be additionally transferred, in targeted manner, from the underside 17*a* of the piston crown 17 to the closure element 23, by way of the contact locations 24. For a further improvement in cooling, the closure element 23 can have additional cooling ribs (not shown). In the exemplary embodiment, the closure element 23 has a domed partial surface 23*a*, in order to enlarge the surface area of the closure element and to circumvent the pin bores 19.

The exemplary embodiment of the closure element 23 shown in FIG. 2 furthermore has a recess 25 that serves as an outflow opening for cooling oil in the assembled state. Of course, outflow openings can be provided in any desired number and configuration, for example in the form of a gap between an edge of the closure element 23 and a corresponding inner wall 12*a* of the piston skirt 12.

FIG. 3, in an enlarged partial representation, shows a further exemplary embodiment of a closure element 123 having contact surfaces 124. The closure element 123 has an additional recess 126, approximately in omega shape in the exemplary embodiment, into which conducting pipe 127 can be clipped in known manner. In this way, cooling oil can be guided into the cooling channel 21 in targeted manner. The cooling oil flowing out of it is then collected by the closure element and passed into cooling space 22, the degree of filling of which space can be controlled to this extent.

The invention claimed is:

1. A piston for an internal combustion engine, comprising:

a piston head (11) having a piston crown (17), a ring belt, an outer circumferential cooling channel (21), an inner cooling space (22) disposed in the region of the underside (17*a*) of the piston crown (17), a piston skirt (12) having inner skirt walls (12*a*), pin bosses (16) that are connected with the underside (17*a*) of the piston crown (17) by way of pin boss connections (18), and having pin bores (19), wherein the inner cooling space (22) is closed off with a separate closure element (23) configured as a separate component fixed to the underside (17*a*) of the piston crown (17) below the outer circumferential cooling channel, said separate closure element having at least one outflow opening (25) and at least one inflow opening for cooling oil, and wherein the closure element (23) and the inner cooling space (22) extend all the way to the inner skirt walls of the piston skirt, below the outer circumferential cooling channel (21).

2. The piston according to claim 1, wherein the at least one outflow opening (25) for cooling oil is configured by means of a gap provided between the inner skirt walls of the piston (10) and an edge of the closure element (23).

3. The piston according to claim 1, wherein the at least one outflow opening (25) is formed by a bore provided in the closure element (23).

4. The piston according to claim 1, wherein a conducting pipe (127) for cooling oil is provided in the at least one inflow opening (126).

5. The piston according to claim 1, wherein the outer circumferential cooling channel (21) is configured to be closed.

6. The piston according to claim 1, wherein the closure element (23) is connected with the piston (10) by means of welding.

7. The piston according to claim 6, wherein the closure element (23) has at least two contact locations (24) that serve as weld points.

8. The piston according to claim 7, wherein the contact locations (24) are configured as spacers between the closure element (23) and the underside (17a) of the piston crown (17).

9. The piston according to claim 1, wherein the closure element (23) is produced from a steel spring sheet.

10. The piston according to claim 1, wherein the piston is configured as a sodium-cooled piston (10) having a closed outer circumferential cooling channel (21).

* * * * *